United States Patent [19]

Ohtani et al.

[11] 4,054,458

[45] Oct. 18, 1977

[54] GELATINO SILVER HALIDE PHOTOSENSITIVE MATERIAL

[75] Inventors: Katsuhiko Ohtani; Yosuke Nakajima; Reiichi Ohi, all of Minami-ashigara; Tokiharu Kondo, deceased, late of Minami-ashigara, Japan; by Yoshiharu Kondo, legal representative, Odawara, Japan

[73] Assignee: Fuji Photo Film Co., Ltd., Minami-ashigara, Japan

[21] Appl. No.: 612,986

[22] Filed: Sept. 12, 1975

Related U.S. Application Data

[63] Continuation of Ser. No. 378,845, July 13, 1973, Pat. No. 3,905,821, which is a continuation-in-part of Ser. No. 74,520, Nov. 2, 1970, abandoned.

[30] Foreign Application Priority Data

Sept. 22, 1969 Japan ..... 44-75467

[51] Int. Cl.[2] ..... G03C 1/28

[52] U.S. Cl. ..... 96/107; 96/108; 96/111

[58] Field of Search ..... 96/111, 107, 109, 108

[56] References Cited

U.S. PATENT DOCUMENTS

| | | | |
|---|---|---|---|
| 3,502,477 | 3/1970 | Ohi et al. | 96/109 |
| 3,549,377 | 12/1970 | Meckl et al. | 96/111 |
| 3,905,821 | 9/1975 | Ohtani et al. | 96/107 |

*Primary Examiner*—Won H. Louie, Jr.
*Attorney, Agent, or Firm*—Sughrue, Rothwell, Mion, Zinn and Macpeak

[57] ABSTRACT

A practical, useful gelatino silver halide photo-sensitive material having incorporated therein a compound represented by the following formula:

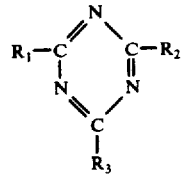

wherein $R_1$, $R_2$ and $R_3$ each represent a hydroxyl group, a hydroxylamino group, an amino group, an alkylamino group of from 1-6 carbon atoms, said alkyl group of said alkylamino group capable of being substituted by a member selected from the group consisting of a hydroxy group, a dialkylamino group of from 2 to 8 carbon atoms and an alkoxy group of from 1 to 4 carbon atoms, an arylamino group, said arylamino group capable of being substituted with a member selected from the group consisting of an alkyl group of from 1 to 4 carbon atoms, an alkoxy group of from 1 to 4 carbon atoms, a hydroxy group and a halogen atom, an alkoxyl group of from 1 to 6 carbon atoms, an aryloxy group, said aryloxy group capable of being substituted with a member selected from the group consisting of an alkyl group of from 1 to 4 carbon atoms, an alkoxy group of from 1 to 4 carbon atoms, a hydroxy group, and a halogen atom, an alkyl group of from 1 to 6 carbon atoms, an aryl group, said aryl group capable of being substituted with a member selected from the group consisting of an alkyl group of from 1 to 4 carbon atoms, an alkoxy group of from 1 to 4 carbon atoms, a hydroxy group, and a halogen atom, or a halogen atom, said compound represented by the above described formula containing no more than one group which is active to gelatin, with the proviso that if $R_1$, $R_2$ or $R_3$ is a halogen atom, no more than one of said $R_1$, $R_2$ and $R_3$ can be a halogen atom.

12 Claims, No Drawings

GELATINO SILVER HALIDE PHOTOSENSITIVE MATERIAL

CROSS-REFERENCE TO RELATED APPLICATIONS

This application is a continuation application of Ser. No. 378,845, filed July 13, 1973, now U.S. Pat. 3,905,821, which is a continuation-in-part application of our earlier co-pending application Ser. No. 74,520 filed on Nov. 2, 1970, now abandoned and claims priority from Japanese Pat. applicaton No. 75,467/69, filed Sept. 22, 1969.

The uniqueness of the above-described invention resides in the fact that the compounds set forth above, do not exhibit a hardening effect on gelatin, but rather, exhibit a sensitizing effect when employed in a gelatino silver halide photo-sensitive material.

BACKGROUND OF THE INVENTION

1. Field of the Invention

The present invention relates to a gelatino silver halide photo-sensitive material, and more particularly, to a practical and useful gelatino silver halide photo-sensitive material containing a compound to effect both the sensitization, due to the increase of the covering power based on control of the hardening, and to prevent the formation of fog.

2. Description of the Prior Art

In the hitherto known production of such gelatino silver halide photo-sensitive material, there have been proposed a great variety of processes to increase the sensitivity and the gamma of the photo-sensitive material, for example, by adding a covering power-increasing agent, for example, natural or synthetic high molecular weight compounds, such as poly-N-vinylpyrrolidone, dextrin, laminarin, mannam, hydroxyethylated cellulose, and the like.

The addition of these compounds makes it possible to effect an increase in the ratio of the optical density of silver to the weight of silver, namely, covering power and increase of contrast.

Generally, the addition of a large quantity of high molecular weight compounds is required; however, this has the disadvantages that the time necessary for development is increased due to the increased thickness of the emulsion layer as well as the adverse effects on the physical strength of the gelatin underlayer.

A primary object of the present invention is to provide a silver halide photo-sensitive material with increased sensitivity, maximum density and contrast based on an increase in covering power.

It is another object of the present invention to provide a photo-sensitive material having a shorter developing time than that of known photo-sensitive materials containing a covering power-increasing agent while preventing a decrease of the physical strength of the gelatin layer.

SUMMARY OF THE INVENTION

The above purposes of the present invention are achieved by incorporating a suitable quantity of a compound represented by the following Formula (I) into a gelatino silver halide emulsion sensitized to its maximum sensitivity by a conventonal chemical sensitization process, for example, a reduction sensitization, a sulfur sensitization, a gold sensitization or combination thereof:

Formula (I):

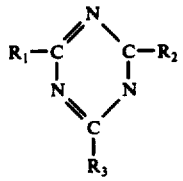

wherein $R_1$, $R_2$ and $R_3$ each represent a hydroxyl group, a hydroxylamino group, an amino group, an alkylamino group of from 1–6 carbon atoms, said alkyl group of said alkylamino group capable of being substituted by a member selected from the group consisting of a hydroxy group, a dialkylamino group of from 2 to 8 carbon atoms and an alkoxy group of from 1 to 4 carbon atoms, an arylamino group, said arylamino group capable of being substituted with a member selected from the group consisting of an alkyl group of from 1 to 4 carbon atoms, an alkoxy group of from 1 to 4 carbon atoms, a hydroxy group and a halogen atom, an alkoxyl group of from 1 to 6 carbon atoms, an aryloxy group, said aryloxy group capable of being substituted with a member selected from the group consisting of an alkyl group of from 1 to 4 carbon atoms, an alkoxy group of from 1 to 4 carbon atoms, a hydroxy group, and a halogen atom, an alkyl group of from 1 to 6 carbon atoms, an aryl group, said aryl group capable of being substituted with a member selected from the group consisting of an alkyl group of from 1 to 4 carbon atoms, an alkoxy group of from 1 to 4 carbon atoms, a hydroxy group, and a halogen atom, or a halogen atom, said compound represented by the above-described formula containing no more than one group which is active to gelatin, with the proviso that if $R_1$, $R_2$ and $R_3$ is a halogen atom, no more than one of said $R_1$, $R_2$ and $R_3$ can be a halogen atom.

Illustrative of suitable alkylamino groups, are such groups as methylamino, dimethylamino, ethylamino, diethylamino, propylamino, butylamino, and the like; illustrative of a substituted alkylamino group, is a hydroxyalkylamino group; illustrative of suitable arylamino groups are those of phenylamino, naphthylamino and the like; illustrative of suitable alkoxyl groups are those of methoxy, ethoxy, propoxy and the like; illustrative of suitable aryloxy groups are those of phenoxy, naphthoxy and the like; illustrative of suitable alkyl groups are those of methyl, ethyl, propyl and the like; illustrative of suitable aryl groups are those of phenyl, naphthyl and the like; and finally, illustrative of suitable halogen atoms are those of chlorine, bromine, fluorine or iodine.

Naturally, the amount of sensitizing compound, as described above, to be added to a gelatino silver halide photographic emulsion will vary, especially depending upon the amount of hardening agent employed. Therefore, all that is generally required, is that a sufficient amount of compound be present so as to exhibit or exert a sensitizing effect. Normally, an amount in the range of from 0.01 to 10.0 grams per mole of silver halide is suitable.

DESCRIPTION OF THE PREFERRED EMBODIMENTS

While the addition of the compound of the present invention somewhat lowers the hardening property, a photo-sensitive material having a gelatin layer with enough strength for practical use can be obtained by suitable control of the quantity of hardening agent added.

The preferred hardening agents applicable to the present invention are selected especially from those having an active halogen, e.g., those of the mucohaloic acid type, such as mucochloric acid, mucobromic acid, those of the halodiazine and halotriazine type, such as 2,4-dichloro-6-hydroxy-1,3,5-triazine sodium salt and the like. Suitable examples of hardening agents of the mucohaloic acid type are described in U.S. Pat. No. 2,983,611, U.S. Pat. No. 3,325,287, U.S. Pat. No. 3,549,377, British Pat. No. 1,072,008 and British Pat. No. 1,193,290; while suitable examples of halodiazine and halotriazine type hardening compounds can be found in U.S. Pat. No. 2,080,019, U.S. Pat. No. 3,579,374 and Belgian Pat. No. 725,964. Also, the use of other aldehyde and epoxy type hardening agents may be effective.

The amount of the hardening agent used in the present invention is from 0.5 milli mole to 10 milli mole, preferably from 4.5 milli mole to 5 milli mole, per Kg of emulsion.

Stabilizers and coating aids may also be employed in the present invention, such as tetrazaidene type stabilizers and saponin type coating aids.

Several embodiments of the compound represented by the above formula which may be practically used in the present invention include the following compounds. These compounds may be used individually or in mixtures thereof, and the present invention should not be limited to the following specific compounds:

Compound 1:

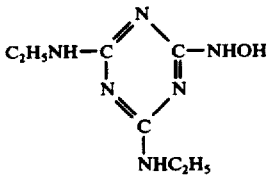

m.p. 194 - 196° C.

Compound 2:

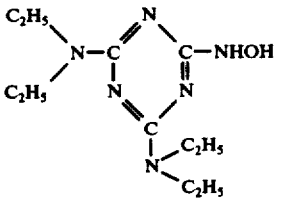

m.p. 146 - 147° C.

Compound 3:

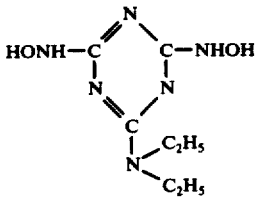

m.p. 190° C.

Compound 4:

-continued

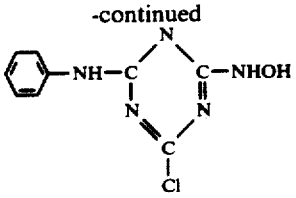

m.p. 105 - 111° C.

Compound 5:

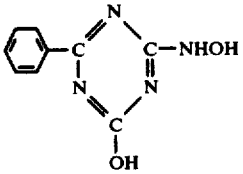

m.p. 250° C.

Compound 6:

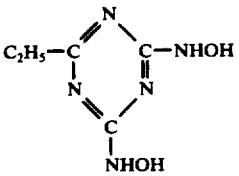

m.p. 208 - 210° C.

Compound 7:

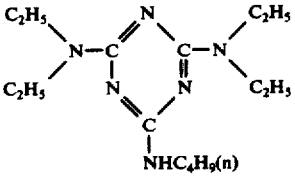

b.p. 183 - 6° C/4.5 mmHg

Compound 8:

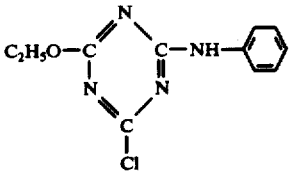

m.p. 110 - 114° C.

Compound 9:

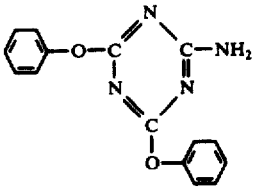

m.p. 181 - 182° C.

Compound 10:

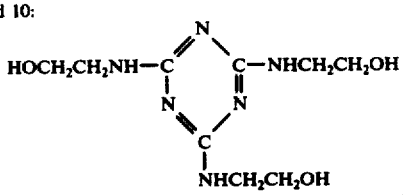

m.p. 97 - 98° C.

The synthesis of these compounds can be easily achieved by reactin of chloro-S-triazine or its derivative with the corresponding amines, phenols and/or alcohols.

Methods of synthesis of the compounds of the present invention have been worked out according to various methods as described in the prior art, for example, Journal of the American Chemical Society, Vol. 73, Page 2981 and Journal of Organic Chemistry, Vol. 27, Page 4054.

A typical example of synthesis will be illustrated as follows:

Example of Synthesis of Compound 1

A solution of 92.2g. of cyanuric trichloride dissolved in 200 ml. of dioxane was added to 300 ml. of water with stirring to prepare a slurry, which was then cooled to 0–5° C. After adding dropwise 64.4g. of a 70% aqueous ethyl amine solution, the system was heated to 40° C., and 300 ml. of an aqueous solution containing 40g. of caustic soda was dropwise added thereto to adjust the pH of the reaction mixture to neutrality.

The crystals deposited after 4 hours were filtered off and washed with water.

A solution of 140g. of hydroxylamine hydrochloride dissolved in 300 ml. of water was cooled to lower than 20° C., and mixed, while passing $N_2$ gas through the solution, with 170 ml. of an aqueous solution contaning 80g. of caustic soda to neutralize the solution, and 500 ml. of dioxane having suspended therein the above crystals was added thereto.

The resulting mixture was then allowed to react for 30 minutes at 50° C., and further for 4 hours at 85° C.

The reactant solution was cooled, after filtering off insoluble matter, to precipitate crystals. The precipitated crystals were filtered off and recrystallized from methanol to obtain the object crystalline compound melting at 197°–198° C. The synthesis of Compounds Nos. 2–4, 7 and 10 were conducted using the corresponding amine in a manner similar to the process of making Compound 1.

Compounds 8 and 9 could be produced from the corresponding amine and alcohol or phenol, and similarly, Compound 5 from 2-phenyl-4,6-dichloro-1,3,5-triazine synthesized in accordance with a method as in the Journal of the American Chemical Society, Vol. 60, page 1657, and Compound 6 from a 2-ethyl derivative.

These compounds can be added to the emulsion in methanol solution or in hydrochloric aqueous solution.

The period of time over which the compound is added to the emulsion is not especially limited, but it is advantageous to perform the addition subsequent to "ripening" thereof but prior to the coating.

There is no particular limitation in the use of specific silver halide compositions in the emulsion, for purposes of the present invention.

Variations in the quantity of the compound used in the present invention are usually dependent upon the kind of hardening agent used therewith, and good results can be obtained by the addition of the compound in a quantity of 0.05–0.5g. per 1 milli mole of the hardening agent.

The support used in the present invention may be selected from those which are conventionally utilized, the particular support not being limited for purposes of the present invention.

That is to say, even if well-known supports, for example, film bases such as polyester film, cellulose triacetate film; dry plate; paper bases such as baryta paper, resin laminated paper, synthetic paper, and metallic plate, etc., are utilized, any one of them is suitable to obtain an effective product.

The following examples will serve more specifically to set forth the present invention, it being understood that the following examples are merely illustrative, and not limiting, in nature.

EXAMPLE 1

4-hydroxy-6-methyl-1,3,3$\alpha$,7-tetrazaidene and saponin were added to a gelatino silver iodobromide emulsion (molar ratio; AgI : AgBr = 1.5 : 98.5) used for a highly sensitive X-ray and was sensitized with both sodium thiosulfate and gold chloride.

The resultant emulsion was mixed with 5 milli mole of mucochloric acid per Kg of emulsion as a hardening agent and various amounts of Compound 1 according to the present invention, then each mixture was coated onto a polyethylene terephthalate base, and dried to a thickness of 5.6$\mu$.

Each sample was exposed through a blue filter to a 5,400° K light source for 1/20 second, developed in a high pH phenidone-hydroquinone developer used for X-ray film. The results are shown in Table 1.

From Table 1, it is clear that the sensitivity and the gamma were increased and the fog was lowered by the addition of the compound of the present invention when compared to the sample tested without the compound of the present invention.

The gamma and the fog were equivalent to those values obtained under developing conditions of 40° C. for 25 seconds.

TABLE 1

| Amount of Compound (g/Kg emulsion) | Specific Sensitivity | Gamma | Fog |
|---|---|---|---|
| 0 | 100 | 1.95 | 0.17 |
| 0.25 | 115 | 1.97 | 0.16 |
| 0.5 | 112 | 2.30 | 0.16 |

EXAMPLES 2–5

In the emulsion as in Example 1, dimethylol urea as the hardening agent was used, instead of the mucochloric acid, together with Compounds 2, 3 and 7 and the results are as shown in Table 2.

For comparison, a known covering power-increasing agent, e.g., polyvinyl pyrrolidone, was used instead of Compound 2 and these results are also shown therein.

TABLE 2

| Example Nos. | Compound | Amount of Compound (g/Kg emulsion) | Specific Sensitivity | Gamma | Fog |
|---|---|---|---|---|---|
| | None | 0 | 100 | 1.70 | 0.20 |
| | Polyvinyl pyrrolidone (comparison) | 0.5 | 112 | 1.80 | 0.23 |
| 2 | Compound 1 | " | 155 | 2.50 | 0.18 |
| 3 | Compound 2 | " | 102 | 1.80 | 0.08 |
| 4 | Compound 3 | " | 160 | 2.52 | 0.20 |
| 5 | Compound 7 | " | 110 | 1.80 | 0.16 |

From the results shown in Table 2, it can be seen that by adding a compound of the present invention, as compared with no additive or a conventional additive, a higher sensitivity and fog and a lower fog are obtained.

Although the present invention has been adequately described and set forth in the foregoing specification and Examples included therein, it is readily apparent that various changes and modifications can be made, by the skilled artisan, without departing from the spirit and scope thereof.

What is claimed is:

1. A gelatino silver halide photo-sensitive emulsion which comprises, a silver halide emulsion sensitized to its maximum sensitivity by conventional chemical sensitization containing a sensitizing effective amount of a sensitizing compound represented by the following formula:

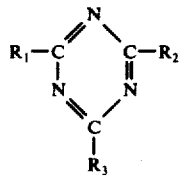

wherein $R_1$, $R_2$ and $R_3$ each represent a hydroxyl group, a hydroxylamino group, an amino group, an alkylamino group of from 1-6 carbon atoms, said alkyl group of said alkylamino group capable of being substituted by a member selected from the group consisting of a hydroxy group, a dialkylamino group of from 2 to 8 carbon atoms and an alkoxy group of from 1 to 4 carbon atoms, an arylamino group, said arylamino group capable of being substituted with a member selected from the group consisting of an alkyl group of from 1 to 4 carbon atoms, an alkoxy group of from 1 to 4 carbon atoms, a hydroxy group and a halogen atom, an alkoxy group of from 1 to 6 carbon atoms, an aryloxy group, said aryloxy group capable of being substituted with a member selected from the group consisting of an alkyl group of from 1 to 4 carbon atoms, an alkoxy group of from 1 to 4 carbon atoms, a hydroxy group, and a halogen atom, an alkyl group from 1 to 6 carbon atoms, an aryl group, said aryl group capable of being substituted with a member selected from the group consisting of an alkyl group of from 1 to 4 carbon atoms, an alkoxy group of from 1 to 4 carbon atoms, a hydroxy group, and a halogen atom, or a halogen atom, said compound represented by the above described formula containing no more than one group which is active to gelatin, with the proviso that if $R_1$, $R_2$ or $R_3$ is a halogen atom, no more than one of said $R_1$, $R_2$ and $R_3$ can be a halogen atom, and an organic hardening agent.

2. The gelatino silver halide photo-sensitive emulsion as claimed in claim 1 wherein the alkylamino group is methylamino, dimethylamino, ethylamino, diethylamino, propylamino or butylamino; wherein the substituted alkylamino group is hydroxyalkylamino; wherein the arylamino group is phenylamino or naphthylamino; wherein the alkoxyl group is methoxy, ethoxy or propoxy; wherein the aryloxy group is phenoxy or naphthoxy; wherein the alkyl group is methyl, ethyl or propyl; wherein the aryl group is phenyl or naphthyl; and wherein the halogen is chlorine, bromine fluorine or iodine.

3. The gelatino silver halide photo-sensitive emulsion as claimed in claim 1 wherein the sensitizing compound is selected from the group consisting of:

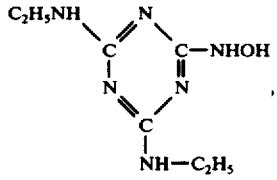

-continued

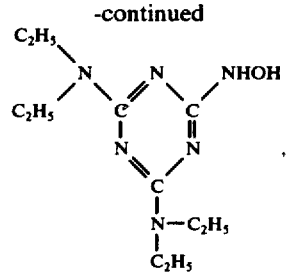

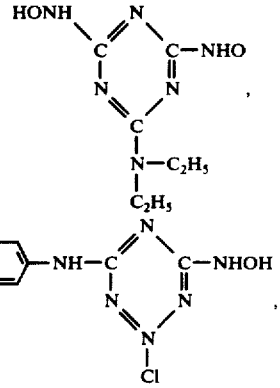

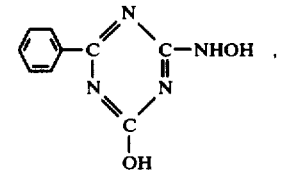

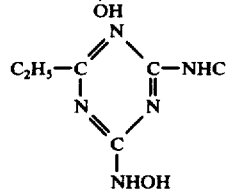

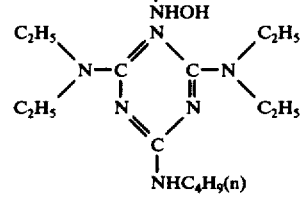

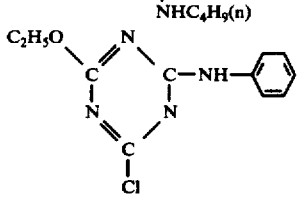

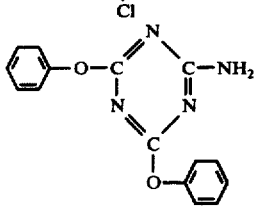

and,

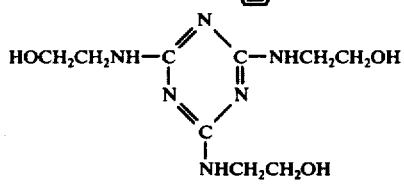

4. The gelatino silver halide photo-sensitive emulsion as claimed in claim 1 wherein the amount of hardening agent varies from 0.5 milli mole to 10 milli mole per Kg of emulsion.

5. The gelatino silver halide photo-sensitive emulsion as claimed in claim 1 wherein the amount of said compound varies from 0.05g. to 0.5g. per milli mole of said hardening agent.

6. The gelatino silver halide photo-sensitive emulsion as claimed in claim 1, wherein the amount of said sensitizing compound ranges from about 0.01g. to about 10.0g. per mole of silver halide present.

7. A gelatino silver halide photo-sensitive material comprising a support having thereon at least one layer containing the silver halide photo-sensitive emulsion as claimed in claim 1.

8. The gelatino silver halide photo-sensitive emulsion as claimed in claim 1, wherein said hardening agent is dimethylol urea.

9. The gelatino silver halide photo-sensitive emulsion as claimed in claim 8, werein said sensitizing compound is m.p. 190° C.

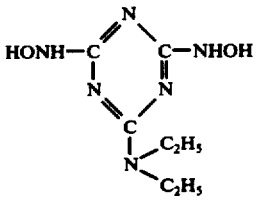

10. The gelatino silver halide photo-sensitive emulsion as claimed in claim 8, wherein said sensitizing compound is m.p. 146 - 147° C.

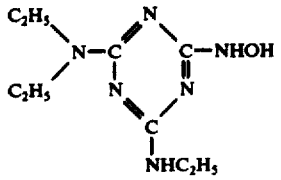

11. The gelatino silver halide photo-sensitive emulsion as claimed in claim 8, wherein said sensitizing compound is b.p. 183-6° C/4.5 mmHg.

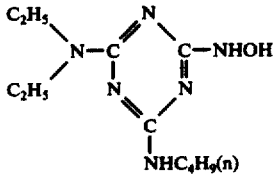

12. The gelatino silver halide photo-sensitive emulsion as claimed in claim 8, wherein said sensitizing compound is m.p. 194 - 196° C.

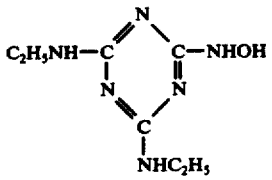

* * * * *